US006662554B2

(12) United States Patent
Sheidler et al.

(10) Patent No.: US 6,662,554 B2
(45) Date of Patent: Dec. 16, 2003

(54) ADJUSTABLE RESTRICTION MUFFLER SYSTEM FOR A COMBINE

(75) Inventors: Alan D. Sheidler, Moline, IL (US); Kyle J. Tingle, Colona, IL (US)

(73) Assignee: Deere & Company, Moline, CA (US)

( * ) Notice: Subject to any disclaimer, the term of this patent is extended or adjusted under 35 U.S.C. 154(b) by 0 days.

(21) Appl. No.: 10/056,122

(22) Filed: Jan. 23, 2002

(65) Prior Publication Data

US 2003/0136116 A1 Jul. 24, 2003

(51) Int. Cl.[7] ..... F01N 3/00

(52) U.S. Cl. ..... 60/290; 60/287; 60/292; 60/324; 181/227; 181/254; 137/487; 137/487.5; 137/861

(58) Field of Search ..... 60/274, 292, 312, 60/324, 313, 305, 290, 287; 181/212, 227, 228, 254, 253; 137/487, 487.5, 861

(56) References Cited

U.S. PATENT DOCUMENTS

| | | | | |
|---|---|---|---|---|
| 1,179,075 | A | | 4/1916 | Collins |
| 1,227,461 | A | | 5/1917 | Losee |
| 1,447,380 | A | | 3/1923 | Goetz |
| 2,968,359 | A | | 1/1961 | Cocker, III |
| 3,749,199 | A | | 7/1973 | Weber |
| 4,248,047 | A | | 2/1981 | Sumi |
| 4,311,008 | A | | 1/1982 | Yamada |
| 4,477,875 | A | | 10/1984 | Suzuki et al. |
| 4,586,908 | A | | 5/1986 | Schlichthorst |
| 4,665,692 | A | | 5/1987 | Inaba |
| 4,682,674 | A | | 7/1987 | Schmidt |
| 4,750,459 | A | | 6/1988 | Schmidt |
| 4,773,215 | A | | 9/1988 | Winberg et al. |
| 4,779,705 | A | | 10/1988 | Verdin |
| 4,785,626 | A | * | 11/1988 | Shiraishi ..... 60/313 |
| 4,851,015 | A | * | 7/1989 | Wagner et al. ..... 55/20 |
| 4,913,260 | A | * | 4/1990 | Fallon ..... 181/254 |
| 4,926,636 | A | * | 5/1990 | Tadokoro et al. ..... 60/312 |
| 5,003,781 | A | | 4/1991 | Shibata et al. |
| 5,197,287 | A | | 3/1993 | Okimoto et al. |
| 5,372,109 | A | | 12/1994 | Thompson et al. |
| 5,630,571 | A | | 5/1997 | Kipp et al. |
| 5,638,926 | A | | 6/1997 | McCrickard |
| 6,000,222 | A | | 12/1999 | Regnier |
| 6,109,027 | A | | 8/2000 | Schaefer |
| 6,257,977 | B1 | | 7/2001 | Moriarty |

FOREIGN PATENT DOCUMENTS

| | | | | |
|---|---|---|---|---|
| DE | 68 03 317 | | 2/1969 | |
| DE | 16 01 350 | | 11/1970 | |
| DE | 295 01 002 | | 5/1995 | |
| FR | 2 534 969 | | 10/1982 | |
| GB | 384 272 | | 2/1931 | |
| JP | 401273819 A | * | 11/1989 | ..... 181/232 |
| JP | 402091410 A | * | 3/1990 | ..... 60/234 |

* cited by examiner

*Primary Examiner*—Thomas Denion
*Assistant Examiner*—Binh Tran
(74) *Attorney, Agent, or Firm*—Polit & Erickson, LLC

(57) ABSTRACT

A bypass for an exhaust system for a utility vehicle, such as a combine, that, when substantially closed, provides maximum noise attenuation for road transport, i.e., relatively high back pressure, and then, when substantially open, would provide a reduced flow restriction, i.e., relatively low back pressure, for full power, field operation. A bypass flow path in an exhaust pipe is located upstream of a primary muffler. A diaphragm can be provided to manipulate a damper which acts to close the exhaust flow to the primary muffler and open the bypass to an exhaust pipe to effectively bypass the primary muffler.

14 Claims, 3 Drawing Sheets

ADJUSTABLE RESTRICTION MUFFLER SYSTEM FOR A COMBINE

TECHNICAL FIELD OF THE INVENTION

The present invention relates to harvesting apparatus, such as combines, and particularly to a muffler system for such combines that effectively increases engine horsepower in operation.

BACKGROUND OF THE INVENTION

Agricultural combines, such as disclosed in U.S. Pat. No. 6,257,977 are used to harvest crops in the field. However, there are times when such combines must be transported or driven on roads to reach the field or to return from the field. Some regulatory bodies have established noise restrictions for utility vehicles that travel on public roads. The "drive-by noise limitations" imposed by TueV and other European regulatory agencies are stringent. As the engine size and power level requirements increase, it becomes more difficult to meet these restrictions.

One source of noise emanating from a vehicle is the exhaust noise. Exhaust noise is usually attenuated by a muffler on the exhaust pipe. Normally, the noise attenuation capability of a muffler is directly proportional to its flow restriction. Flow restriction is typically measured as back pressure. Increased exhaust noise attenuation typically results in increased back pressure at the engine exhaust manifold which limits the available power from the engine.

Increased exhaust back pressure typically results in decreased available engine power, decreased fuel economy and possibly decreased turbocharger durability.

The present inventors have recognized that maximum power requirement for a combine does not occur in a road transport situation where the drive-by noise regulation must be restricted. The maximum power requirement occurs in the field. For transport on the road, the power requirement would be less than three quarters of the maximum rated power, the engine speed can be reduced, and the corresponding exhaust flows are much less than maximum flows. The present inventors have recognized that a muffler can be sized to meet these limited exhaust flows for noise attenuation requirements for road transport, but that such muffler would be too restrictive for full power operation in the field.

The present inventors have recognized that it would be desirable to develop a muffler system that reduces noise to acceptable levels during road transport, without imposing excessive back pressure limitations on the engine when operated in the field.

SUMMARY OF THE INVENTION

The present invention provides a bypass for an exhaust system for a utility vehicle, such as a combine, that, when substantially closed, would provide maximum noise attenuation for road transport, i.e., relatively high back pressure, and then, when substantially open, would provide a reduced flow restriction, i.e., relatively low back pressure, for full power, field operation.

The invention provides a bypass flow path in an exhaust pipe located upstream of a primary muffler. A diaphragm can be provided to manipulate a damper which acts to close the exhaust flow to the primary muffler and open the bypass to an exhaust pipe to effectively bypass the primary muffler, for field use of the utility vehicle. The system can be configured to entirely bypass the primary muffler and entirely route exhaust gases through the bypass or can be a system which bypasses a portion of the flow to effectively reduce back pressure while still maintaining some flow through the primary muffler. This would reduce the level of noise while still reducing back pressure to some extent. Additionally, the system could be configured to bypass exhaust gas from the primary, more restrictive muffler, to allow flow either entirely or proportionally to a less restrictive secondary muffler. Alternatively, the system could be configured such that the secondary muffler is not necessarily less restrictive, but the combined flow path through both primary and secondary mufflers is significantly less restrictive than through the primary muffler alone.

The amount of flow directed through the bypass would be dependent on the damper position. The damper position can be controlled by a diaphragm subject to positive air pressure delivered through an air line from the intake manifold of the engine, the air pressure being dependent on engine load for a turbocharged engine. Alternately, for a normally aspirated engine, intake manifold vacuum could be used to move the diaphragm. A solenoid valve can be inserted in the air line for more precise control. The solenoid valve can be controlled by a controller, preferably an electronic control unit of the vehicle. The degree of modulation of the damper could be controlled by the electronic control unit to be proportional to power requirements of the combine. When power requirements are low, all of the exhaust gases can be passed through the primary muffler. When power requirements are increased, progressively increasing amounts of exhaust gases can be bypassed by the opening of the damper, through the bypass flow path. Thus, even in the field where road noise restrictions are not applicable, a maximum amount of noise attenuation is achieved corresponding to the power demand.

The positioning of the damper can be undertaken in different ways. For example, the damper can be manually positioned by a lever and push/pull cable located in the vehicle cab and extending to the damper. Alternately, a solenoid valve can be signal connected to a manual selection switch and supplied with pressurized air, or vacuum, to manually control air pressure on the diaphragm that is connected to the damper. Alternately, the damper could be spring loaded to urge the bypass closed but which would be urged open by increasing back pressure. Alternately, an electrical switch could be triggered by an operator to open the bypass damper by use of a motorized screw thread actuator or stepper motor.

The bypass system could be electronically deactivated when the combine is placed in a higher gear used only for road travel, i.e., forcing all exhaust gas through the primary muffler. This would ensure compliance with road noise restrictions.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
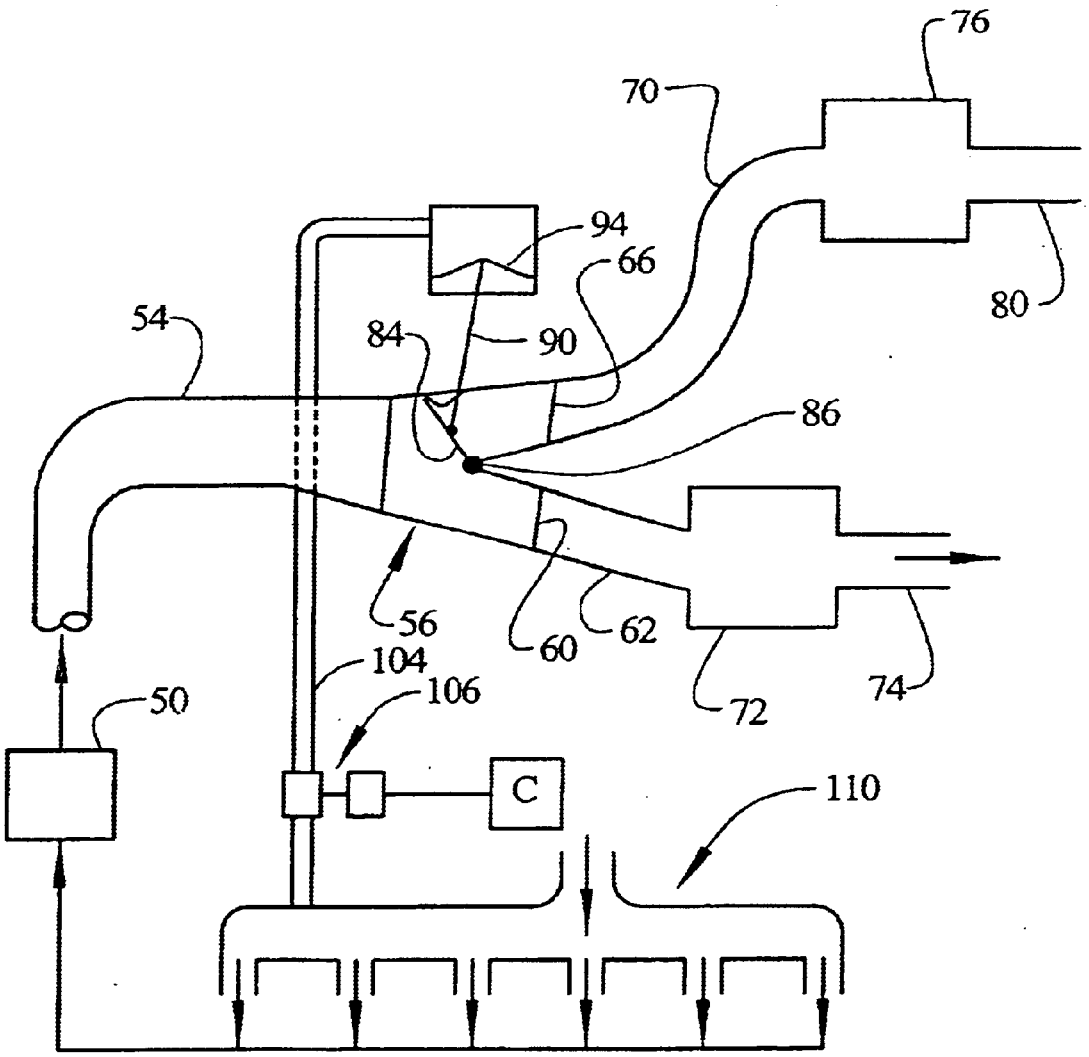
FIG. 1 is a schematic diagram of a muffler system according to the present invention, shown with the damper in a road transport position.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates an engine 50 connected to an exhaust pipe 54 which connects to a valve station 56. The valve station 56 is connected to two outlets, a first outlet 60 which is connected to a muffler pipe 62 and a second connection 66 connected to a bypass pipe 70. The muffler pipe 62 is connected to a first muffler 72 connected to a first tail pipe 74.

The bypass pipe 70 can be connected to a second muffler 76 that is connected to a second tail pipe 80. The second muffler 76 can be a less restricted muffler for passing a substantial amount of the total exhaust flow at lower back pressure than the first muffler 62, or could be more or less restrictive than the first muffler wherein the passing of the total exhaust gas through both mufflers results in a decreased back pressure during field use of the combine. Alternatively, the second muffler 76 can be eliminated entirely and the bypass pipe 70 can be connected to, or formed integral with, the tail pipe 80.

Within the valve station 56 is a moveable damper 84. The damper is pivotal about a pivot point 86. In the position shown in FIG. 1, the damper is in a position such that all of the exhaust flows through the first muffler 72. The damper is connected to an actuator rod 90 that is connected to a diaphragm 94. The diaphragm is in pressure communication with a control air line 104. The control air line 104 is connected to a pressurized air intake manifold 110 which delivers combustion air into the internal combustion engine 50. As boost pressure in the intake manifold 110 increases, the damper is proportionally opened to bypass an amount of exhaust gas to the outlet 66 of the station 56. The exhaust back pressure would thus be reduced during high power demand.

A solenoid valve 106 can be connected in the control air line 104. The solenoid valve can be signal connected to a controller, such as a microprocessor based electronic control unit. Such controllers are associated with the combine transmission and control engine speed and transmission power output to the wheels. Such controllers are used to optimize vehicular efficiency. The controller can progressively open the bypass as power demand is made on the combine in the field.

Alternatively, the solenoid valve can be controlled manually by an operator activated electrical switch that opens or closes the solenoid valve.

Figure 2:
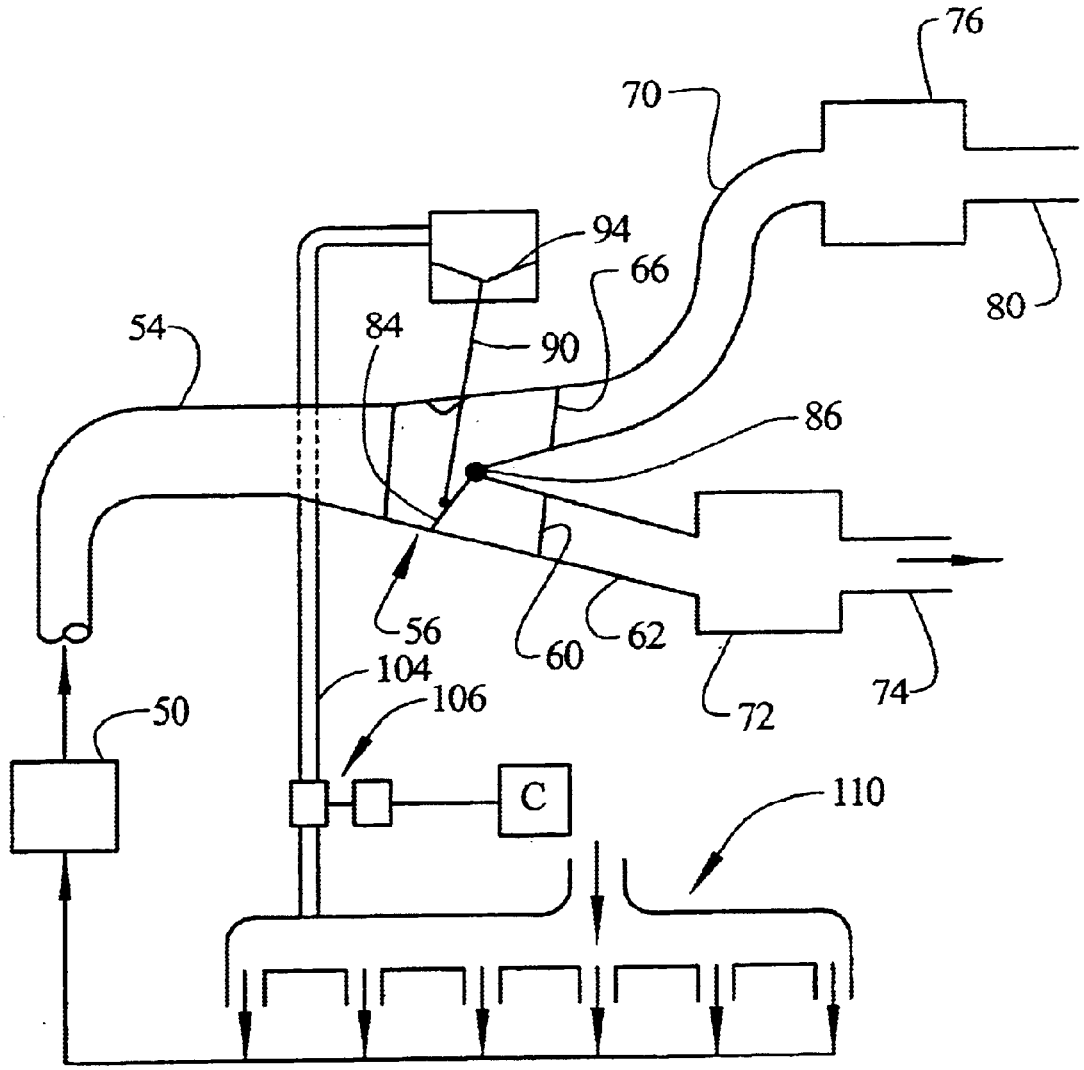
FIG. 2 is a schematic diagram of a muffler system according to the present invention, shown with the damper in a full power field position.

FIG. 2 illustrates the system of FIG. 1 with the damper moved to close the exhaust pathway through the muffler and to open the bypass pathway. In this exhaust configuration, the exhaust system would be less restrictive and would result in more available horsepower from the engine when operated in the field where noise restrictions are not as important compared to operation during road transport.

Figure 3:
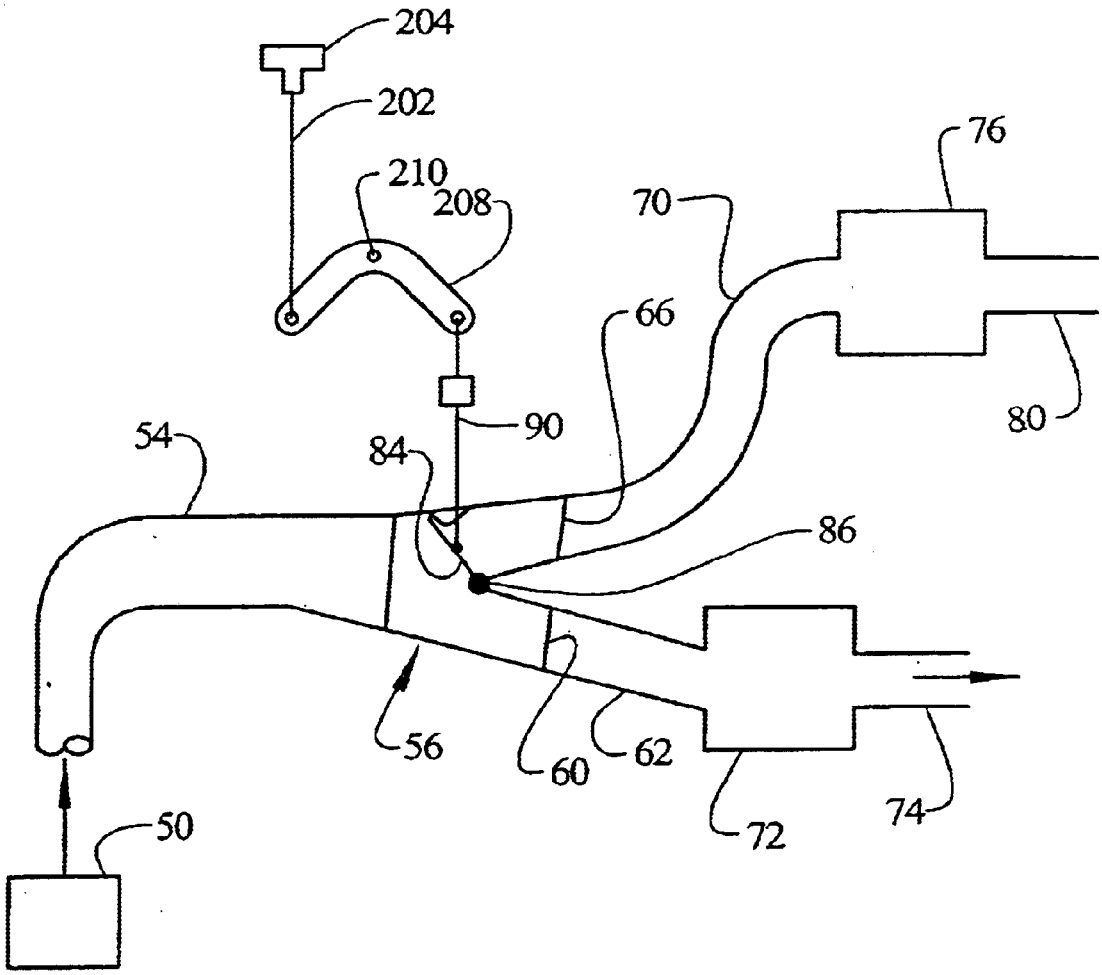
FIG. 3 is a schematic diagram of a further embodiment muffler system according to the present invention that uses a manual mechanism to effect exhaust bypass of the primary muffler.

FIG. 3 illustrates an alternate embodiment wherein a manual push-pull cable 202 is connected to an operator controlled handle or lever 204. The cable 202 is connected to a bell crank 208, the bell crank pivoted at a point 210 to the combine body. An opposite end of the bell crank is connected to the actuator rod 90. Pushing or pulling the handle 204 would close or open the bypass outlet 66.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An exhaust system for a combine comprising;

an internal combustion engine configured to drive the combine on a roadway at roadway speeds and in a field at harvesting speeds;

an exhaust pipe from the internal combustion engine;

a muffler flow-connected to said exhaust pipe and arranged to direct exhaust gas to atmosphere;

a bypass exhaust path that is flow-connected to said exhaust pipe, said bypass exhaust path arranged to direct exhaust gas around said muffler to atmosphere;

a valve arranged between said exhaust pipe and said bypass, said valve operable to close said bypass exhaust path during operation of said combine at roadway speeds to increase exhaust system flow restriction and sound attenuation, and operable to at least partially open said bypass exhaust path when operating said combine at harvesting speeds to decrease exhaust system flow restriction and sound attenuation.

2. The exhaust system according to claim 1, wherein said bypass exhaust path comprises a second muffler.

3. The exhaust system according to claim 1, wherein said valve comprises a damper that is controlled by an air actuated diaphragm, said diaphragm air connected to a source of pressurized air, and including a solenoid valve connected into said air line, said solenoid valve operable by an electronic control unit.

4. The exhaust system according to claim 3, wherein said electronic control unit modulates said valve in accordance with power requirements of said combine.

5. The system according to claim 3, wherein said electronic control unit actuates said damper in response to gear selection.

6. The system according to claim 1, wherein said valve comprises a damper that moves from a position which doses said bypass exhaust path and opens exhaust gas flow to said muffler, to a position which opens said bypass exhaust path and closes exhaust gas flow to said muffler.

7. The system according to claim 1, wherein said valve comprises a damper, and comprising a manual mechanism to open and close said damper.

8. An exhaust system for a combine comprising:

an internal combustion engine configured to drive the combine on a roadway at roadway speeds and in a field at harvesting speeds;

an exhaust pipe from the internal combustion engine;

a bypass pipe flow-connected to said exhaust pipe;

a muffler pipe flow-connected to said exhaust pipe;

a first muffler flow-connected to said muffler pipe;

a damper arranged between said exhaust pipe and said bypass pipe, said damper operable to close said bypass pipe during operation of said combine at roadway speeds to increase exhaust system flow restriction and sound attenuation, and operable to at least partially open said bypass pipe when operating said combine at harvesting speeds to decrease exhaust system flow restriction and sound attenuation.

9. The exhaust system according to claim 8, comprising a second muffler connected to said bypass pipe downstream from said damper.

10. The exhaust system according to claim 8, wherein said damper is controlled by an air actuated diaphragm, said diaphragm air connected to a source of pressurized air, and including a solenoid valve connected into said air line, said solenoid valve operable by an electronic control unit.

11. The exhaust system according to claim 10, wherein said electronic control unit modulates said damper in accordance with power requirements of said combine.

12. The system according to claim 11, wherein said electronic control unit actuates said damper in response to gear selection.

13. The system according to claim 8, wherein said damper moves from a position which closes said bypass pipe and opens said muffler pipe, to a position which opens said bypass pipe and closes said muffler pipe.

14. The system according to claim 8, comprising a manual mechanism to open and close said damper.

* * * * *